US010800638B2

(12) United States Patent
Bonatre et al.

(10) Patent No.: US 10,800,638 B2
(45) Date of Patent: Oct. 13, 2020

(54) ELEVATOR SYSTEM WITH VENTILATION SYSTEM

(71) Applicant: Otis Elevator Company, Farmington, CT (US)

(72) Inventors: Guillaume Bonatre, Dusson sur Loire (FR); Sebastien Mougin, Saint Florent le Jeune (FR); Rene Gonzalez, St. Maurice l'exil (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/533,868

(22) PCT Filed: Dec. 23, 2014

(86) PCT No.: PCT/IB2014/003127
§ 371 (c)(1),
(2) Date: Jun. 7, 2017

(87) PCT Pub. No.: WO2016/102995
PCT Pub. Date: Jun. 30, 2016

(65) Prior Publication Data

US 2017/0320707 A1 Nov. 9, 2017

(51) Int. Cl.
*B66B 11/02* (2006.01)
*B66B 11/00* (2006.01)
(Continued)

(52) U.S. Cl.
CPC ..... *B66B 11/0005* (2013.01); *B66B 11/024* (2013.01); *B66B 13/30* (2013.01); *F24F 7/007* (2013.01)

(58) Field of Classification Search
CPC ... B66B 11/0005; B66B 11/024; B66B 13/30; F24F 7/007
See application file for complete search history.

(56) References Cited

U.S. PATENT DOCUMENTS 1,872,007 A 8/1932 Reilly
2,310,414 A * 2/1943 Emil Fritzam ..... B66B 11/024 454/251
(Continued)

FOREIGN PATENT DOCUMENTS

CN 1296268 A 5/2001
CN 1192963 C 3/2005
(Continued)

OTHER PUBLICATIONS

PCT Notification of Transmittal of the International Search Report; International Application No. PCT?IB2014/003127; International Filing Date: Dec. 23, 2014; dated Nov. 10, 2015; pp. 1-7.
(Continued)

*Primary Examiner* — Michael A Riegelman
(74) *Attorney, Agent, or Firm* — Cantor Colburn LLP

(57) ABSTRACT

An elevator system (20) is provided including a hoistway (22) and an elevator car (24) movable within the hoistway (22) between a plurality of landings (26). The elevator car (24) includes at least one air scoop (70) configured to fluidly couple an interior of the elevator car (24) to the hoistway (22) such that a controlled fluid flow may pass there between. The hoistway (22) may or may not include a ventilation opening (50) configured to couple the hoistway (22) to an air source disposed outside of the hoistway (22).

7 Claims, 4 Drawing Sheets

(51) Int. Cl.

| | |
|---|---|
| ***B66B 13/30*** | (2006.01) |
| *F24F 7/007* | (2006.01) |

(56) References Cited

U.S. PATENT DOCUMENTS

| | | | | | |
|---|---|---|---|---|---|
| 2,350,389 | A * | 6/1944 | Coulton | B66B 11/024 | 454/68 |
| 2,398,627 | A * | 4/1946 | Disbro | B66B 11/024 | 422/121 |
| 2,532,268 | A * | 11/1950 | Christmann | B66B 11/024 | 187/414 |
| 2,586,797 | A | 2/1952 | Dunlop et al. | | |
| 2,787,139 | A * | 4/1957 | Salazar | F24F 5/0007 | 187/414 |
| 4,122,685 | A * | 10/1978 | Ruff | E04F 17/005 | 52/30 |
| 4,286,507 | A * | 9/1981 | Dorpmund | B65D 88/741 | 220/1.5 |
| 4,637,176 | A * | 1/1987 | Acock, Jr. | B66B 11/004 | 187/239 |
| 4,747,242 | A * | 5/1988 | Aarstad | E04H 6/06 | 187/209 |
| 5,080,003 | A * | 1/1992 | Kappeler | B66B 11/024 | 187/401 |
| 5,251,726 | A * | 10/1993 | de Jong | B66B 13/285 | 187/401 |
| 5,306,208 | A * | 4/1994 | Sommerrock | B66B 11/024 | 454/254 |
| 5,354,233 | A * | 10/1994 | Mandy | B66B 11/024 | 187/393 |
| 5,447,211 | A * | 9/1995 | Sors | B66B 9/04 | 182/48 |
| 7,284,640 | B2 | 10/2007 | Lee | | |
| 7,424,935 | B1 | 9/2008 | Smith | | |
| 9,604,822 | B2 * | 3/2017 | Roivainen | B66B 13/301 | |
| 2005/0000754 | A1 * | 1/2005 | Lee | B66B 11/024 | 187/277 |
| 2005/0124282 | A1 * | 6/2005 | Santos | B66B 11/024 | 454/68 |
| 2006/0070823 | A1 * | 4/2006 | Huang | B66B 11/0233 | 187/401 |
| 2008/0146135 | A1 | 6/2008 | Hein et al. | | |
| 2008/0190711 | A1 * | 8/2008 | Patrick | B66B 11/024 | 187/401 |
| 2009/0038473 | A1 * | 2/2009 | Kwon | B03C 3/12 | 95/3 |
| 2010/0032589 | A1 * | 2/2010 | Leben | A61L 2/10 | 250/504 R |
| 2012/0164928 | A1 * | 6/2012 | Wuest | B66B 11/024 | 454/68 |
| 2013/0220742 | A1 * | 8/2013 | Mielonen | B66B 11/0206 | 187/401 |
| 2014/0305749 | A1 * | 10/2014 | Manner | B66B 11/0226 | 187/401 |
| 2015/0121764 | A1 | 5/2015 | Lee | | |
| 2017/0001838 | A1 * | 1/2017 | Polak | B66B 11/0206 | |
| 2017/0122608 | A1 * | 5/2017 | Havia | E06B 7/10 | |
| 2017/0355564 | A1 | 12/2017 | Bonatre | | |
| 2018/0009638 | A1 * | 1/2018 | Fargo | B66B 1/34 | |

FOREIGN PATENT DOCUMENTS

| | | | |
|---|---|---|---|
| CN | 1772589 | A | 5/2006 |
| CN | 1298607 | C | 2/2007 |
| CN | 1302980 | C | 3/2007 |
| CN | 1968884 | A | 5/2007 |
| CN | 101198539 | A | 6/2008 |
| CN | 201071240 | Y | 6/2008 |
| CN | 101481063 | A | 7/2009 |
| CN | 201801274 | U | 4/2011 |
| CN | 102328866 | A | 1/2012 |
| CN | 202785150 | U | 3/2013 |
| CN | 202988489 | U | 6/2013 |
| CN | 203158990 | U | 8/2013 |
| CN | 103332561 | A | 10/2013 |
| CN | 103754735 | A | 4/2014 |
| CN | 203794407 | U | 8/2014 |
| DE | 202009017374 | U1 | 5/2011 |
| DE | 102012101046 | A1 | 8/2012 |
| EP | 1873109 | A1 | 1/2008 |
| EP | 1890956 | A1 | 2/2008 |
| JP | 3138283 | A | 6/1991 |
| JP | 680357 | A | 3/1994 |
| JP | H10279200 | A | 10/1998 |
| JP | 2001294384 | A | 10/2001 |
| JP | 2012180213 | A | 9/2012 |
| JP | 2013237545 | A | 11/2013 |
| KR | 20030063595 | A | 7/2003 |
| WO | 2006134016 | A1 | 12/2006 |

OTHER PUBLICATIONS

PCT Search, Written Opinion; International Application No. PCT/IB2014/003127; International Filing Date: Dec. 23, 2014; dated Nov. 10, 2015; pp. 1-9.

"Liftairetm II Elevator Air Conditioner the Latest in a Series of Air Conditioners/Heaters Designed Specifically for Use in Elevators," Elevator World, Elevator World Inc., Birmingham, Al, US, vol. 49, No. 7, Jul. 1, 2001, p. 72 (XP001092694).

Chinese Office Action with english translation; CN application No. 201480084331.6 (PCT/IB2014/003127); dated Aug. 28, 2018; pp. 1-19.

PCT ISR Written Opinion; International Application No. PCT/IB2015/001125; International Filing Date: Jun. 11, 2015; dated Dec. 4, 2015; pp. 1-8.

PCT Notification of Transmittal of The International Search Report; International Application No. PCT/IB2015/001125; International Filing Date: Jun. 11, 2015; dated Dec. 4, 2015; pp. 1-6.

PCT Invitation to Pay Additional Fees and, Where Applicable, protest Fee, International Application No. PCT/IB2014/003127; International Filing Date: Dec. 23, 2014: dated Sep. 2, 2015; pp. 1-4.

The State Intellectual Property Office of the People'S Republic of China, First Office Action, Application No. 201580070633.2, dated Sep. 3, 2018, with English translation (14 pp.).

Chinese Office Action: International Application No. 201480084331.6; International Filing Date: Jun. 23, 2017; dated Mar. 3, 2020; 7 pages.

Chinese Office Action; International Application No. 201480084331.6; International Filing Date: Jun. 23, 2017; dated Mar. 11, 2019; 7 pages.

U.S. Non-Final Office Action; U.S. Appl. No. 15/536,266; Application Filing Date: Jun. 11, 2014; dated Jun. 28, 2019; 12 pages.

* cited by examiner

ELEVATOR SYSTEM WITH VENTILATION SYSTEM

CROSS REFERENCE TO RELATED APPLICATION

This application is a National Stage application of PCT/IB2014/003127, filed Dec. 23, 2014, which is incorporated by reference in its entirety herein.

BACKGROUND OF THE INVENTION

Embodiments of the invention relate to an elevator system, and more particularly, to a ventilation system of an elevator system configured to reduce energy waste.

Existing regulations require that an elevator system includes both hoistway ventilation and car ventilation for mechanic and passenger health and safety in all circumstances including shut down resulting in entrapment. With respect to hoistway ventilation, conventional systems typically include a ventilation opening formed at the top of the hoistway to fluidly connect the hoistway to an outside air source.

With respect to the car ventilation, the interior of an elevator car is defined by a plurality of car walls and at least one car door including a car door panel and door columns. Multiple openings having a cross-sectional area equal to a percentage of the floor area are typically formed near the top and bottom of the walls or door column of the elevator car. Air from the hoistway flows through these wall openings and through gaps formed between car door panels and door columns to adequately ventilate the interior of the car.

With the advancement of global warming and increasing energy costs, there is a desire to minimize the amount of energy consumed by both new and existing buildings. Conventional ventilation systems of an elevator, however, tend to be conservatively designed and implemented and therefore result in significant energy losses for the building. For example, conditioned air within the building may escape through the opening formed at the top of the hoistway resulting in a loss of heat and energy.

BRIEF DESCRIPTION OF THE INVENTION

According to one embodiment of the invention, an elevator system is provided including a hoistway and an elevator car movable within the hoistway between a plurality of landings. The elevator car includes at least one air scoop configured to fluidly couple an interior of the elevator car to the hoistway such that a controlled fluid flow may pass there between.

In addition to one or more of the features described above, or as an alternative, in further embodiments the hoistway does not include a ventilation opening configured to fluidly couple the hoistway to an external air supply.

In addition to one or more of the features described above, or as an alternative, in further embodiments the hoistway includes a ventilation opening configured to fluidly couple the hoistway to an external air supply.

In addition to one or more of the features described above, or as an alternative, in further embodiments the ventilation opening is selectively or continuously covered.

In addition to one or more of the features described above, or as an alternative, in further embodiments a landing door is arranged at one or more of the plurality of landings, the landing door being optimized to allow a selected amount of fluid flow there through when in a closed position.

In addition to one or more of the features described above, or as an alternative, in further embodiments the air scoop includes a first portion having an enlarged opening configured as an air intake or outtake.

In addition to one or more of the features described above, or as an alternative, in further embodiments the at least one air scoop is mounted to a wall structure of the elevator car.

In addition to one or more of the features described above, or as an alternative, in further embodiments the at least one air scoop is arranged within a door column of the wall structure.

In addition to one or more of the features described above, or as an alternative, in further embodiments the at least one air scoop is mounted adjacent a car roof of the elevator car.

According to another embodiment of the invention, an elevator system is provided including a hoistway that does not include a ventilation opening configured to fluidly couple the hoistway to an external air supply. An elevator car is movable within the hoistway between a plurality of landings. A landing door arranged at one or more of the plurality of landings is movable between an open position and a closed position. The landing door is optimized to allow a selected amount of fluid flow there through when in a closed position.

In addition to one or more of the features described above, or as an alternative, in further embodiments the elevator car includes at least one air scoop configured to supply air from the hoistway to an interior of the elevator car such that a controlled fluid flow may pass there between.

In addition to one or more of the features described above, or as an alternative, in further embodiments the air scoop includes a first portion having an enlarged opening configured as an air intake or outtake.

In addition to one or more of the features described above, or as an alternative, in further embodiments the at least one air scoop is mounted to a wall structure of the elevator car.

In addition to one or more of the features described above, or as an alternative, in further embodiments the at least one air scoop is arranged within a door column of the wall structure.

In addition to one or more of the features described above, or as an alternative, in further embodiments the at least one air scoop is mounted to roof of the elevator car.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
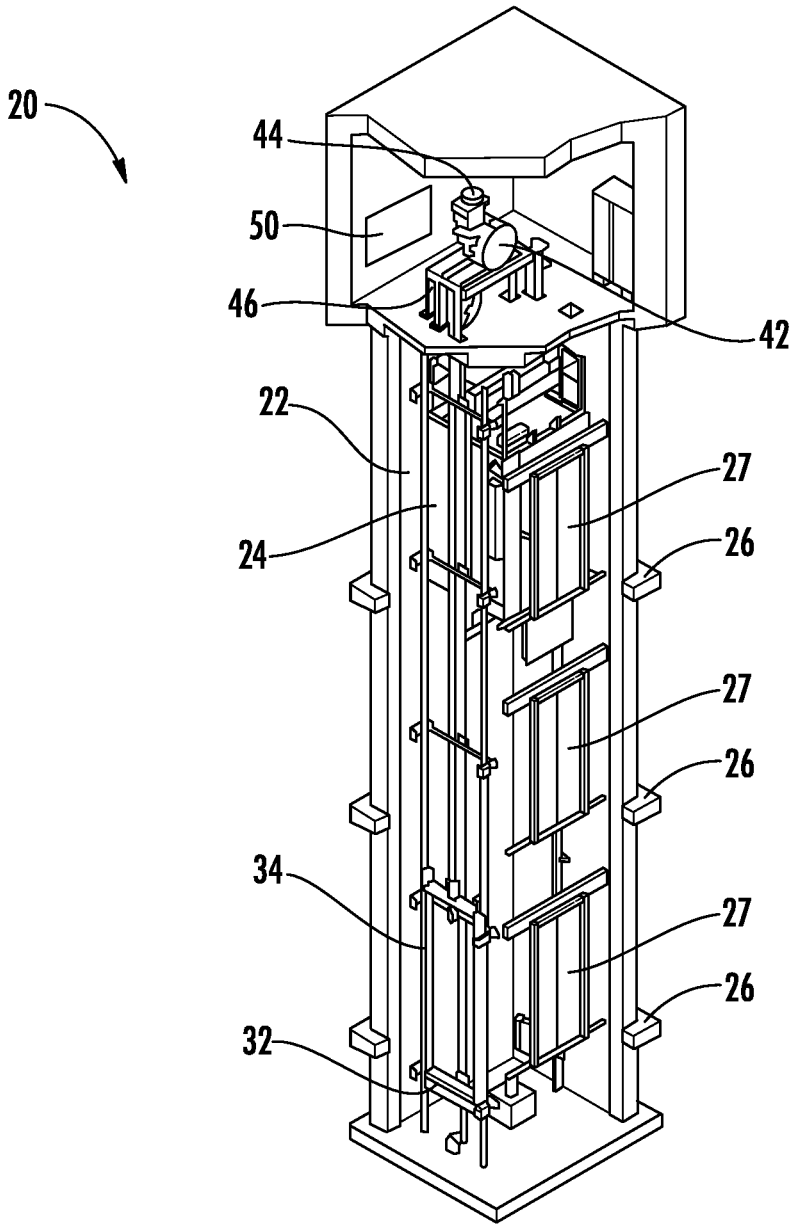
FIG. 1 is a perspective view of an elevator system according to an embodiment of the invention.
Figure 2:
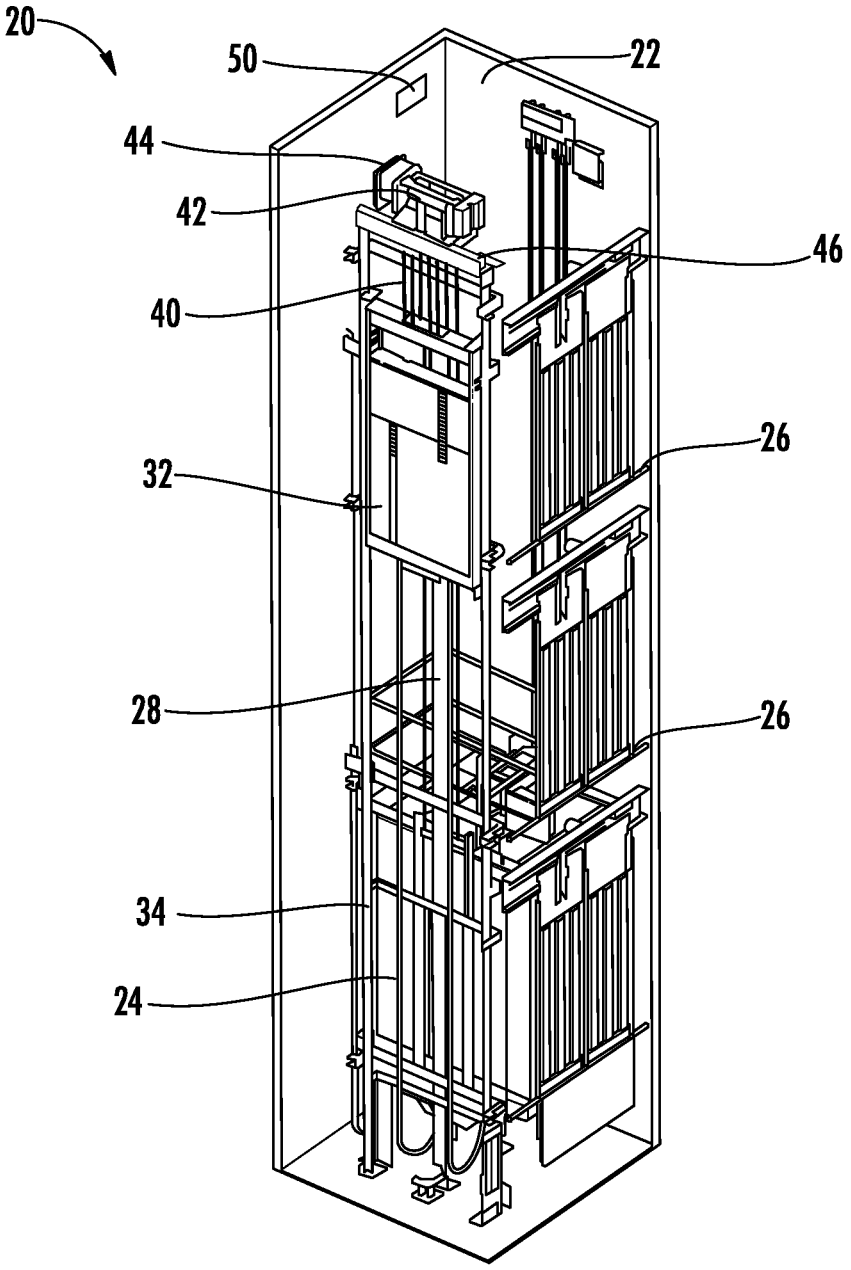
FIG. 2 is a perspective view of another elevator system according to an embodiment of the invention.

Referring now to FIGS. 1 and 2, examples of an elevator system 20 resulting in reduced energy losses for a building are illustrated. In the illustrated, non-limiting embodiment, the elevator system 20 includes an elevator car 24 configured to move vertically upwardly and downwardly within a hoistway 22 between two or more landings 26 along car guide rails 28. As shown, the hoistway 22 may be fully enclosed (FIG. 1), or only partially enclosed (FIG. 2), such as when the elevator system 20 is positioned within an atrium for example. Guide assemblies 30 mounted to the top and bottom of the elevator car 24 are configured to engage the car guide rails 28 to maintain proper alignment of the elevator car 24 as it moves within the hoistway 22.

The elevator system 20 additionally includes a counterweight 32 configured to move vertically upwardly and downwardly within the hoistway 22. The counterweight 32 moves in a direction generally opposite the movement of the elevator car 24 as is known in conventional elevator systems. Movement of the counterweight 32 is guided by counterweight guide rails 34 mounted within the hoistway 22. The elevator car 24 and counterweight 32 include sheave assemblies (not shown) that cooperate with at least one load bearing member 40 and a traction sheave 42 mounted to a drive machine 44 to raise and lower the elevator car 24. The drive machine 44 in the illustrated embodiment of the invention is suited and sized for use with flat, belt-like load bearing members 40. However, other load bearing members 40, such as steel or composite ropes or cables for example, are within the scope of the invention. The sheave assemblies 36, shown in FIG. 2, are mounted at the bottom of the elevator car 24, in an underslung configuration. However, the one or more sheave assemblies 36 may be mounted at another location on the elevator car 24, such as the top of the elevator car 24 for example, or elsewhere in the system 20 as recognized by a person skilled in the art.

The drive machine 44 of the elevator system 20 is positioned and supported at a mounting location atop a support member 46, such as a bedplate for example, in a portion of the hoistway 22 (FIG. 2) or in a machine room (FIG. 1). Although the elevator system 20 illustrated and described in FIG. 1 has a 1:1 roping and the elevator system of FIG. 2 has an underslung 2:1 roping configuration, elevator systems 20 having other roping configurations and hoistway layouts are within the scope of the invention. In addition, other elevator systems including hydraulic and linear motor systems are within the scope of the invention.

In one embodiment, the hoistway 22 of the elevator system 20 configured to reduce energy losses of a building may have a ventilation system including a ventilation opening 50, illustrated schematically in FIGS. 1 and 2, fluidly connecting the hoistway 22 to an air source disposed outside of the hoistway 22. For example, a ventilation opening 50 may be formed in the hoistway 22 above the top landing 26 of the elevator system 20, such as within the machine room. In another embodiment, the hoistway 22 is not coupled to an air source. For example, the hoistway 22 may not include a ventilation opening 50, or alternatively, may include a selectively or continuously sealed ventilation opening 50 to reduce or minimize the amount of energy lost, such as heat escaping through the ventilation opening 50 for example.

In embodiments where the hoistway 22 does not include a ventilation opening 50, or where the ventilation opening 50 is selectively or continuously sealed in a closed position, the landing doors 27 arranged at each landing 26 in the hoistway 22 (see FIG. 1 or 2) may be configured to allow a selected amount of fluid flow there through, both into and out of the hoistway 22, when in a closed position. For example, the selected amount of air may be the minimum airflow requirement dictated by one or more elevator and building code authorities. More specifically, the landing doors 27 may be optimized such that in combination, the minimum amount of airflow required is able to pass through the landing doors 27 and into the hoistway 22.

Figure 3:
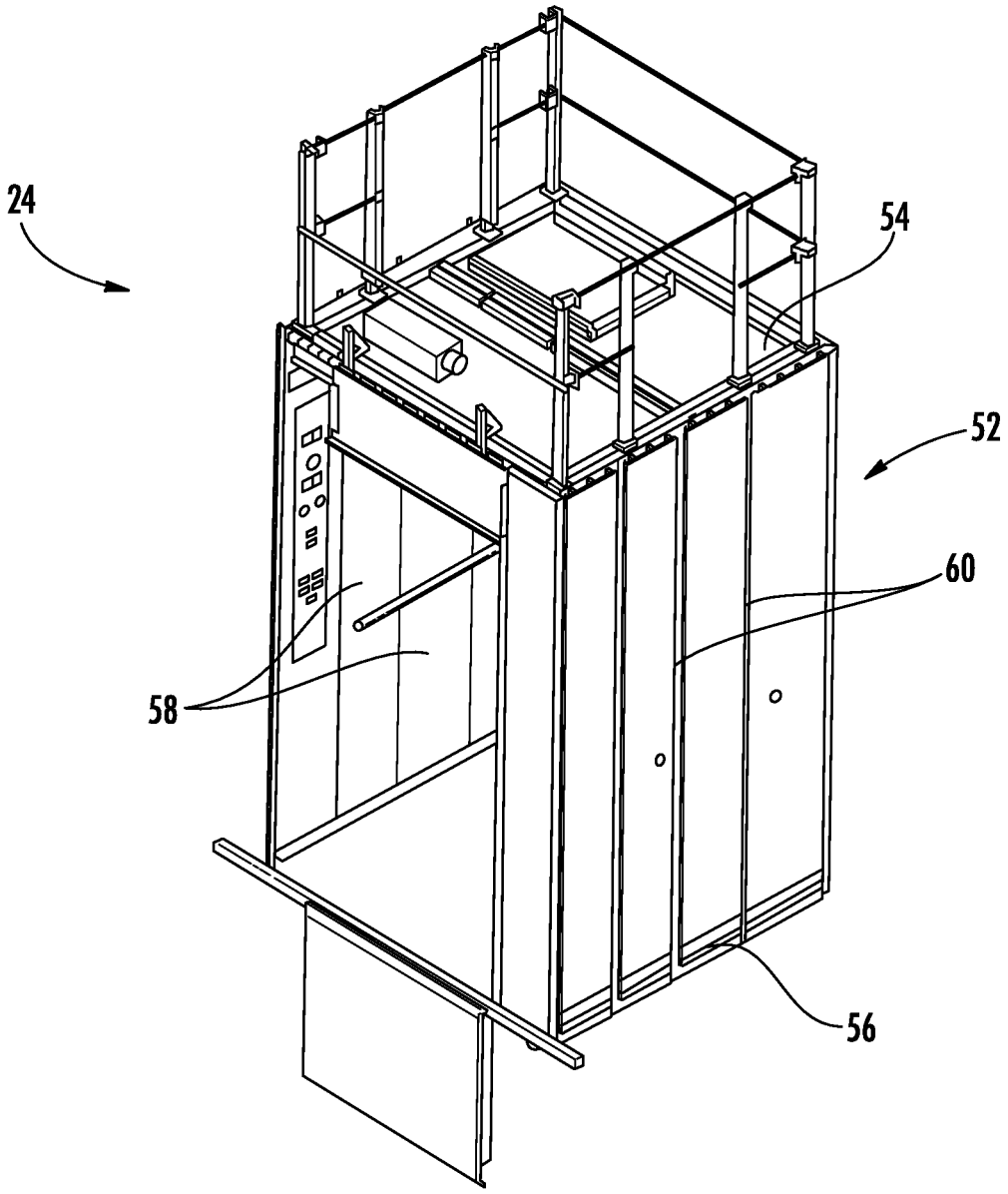
FIG. 3 is a perspective view of an elevator car of the elevator system of FIGS. 1 and 2 according to an embodiment of the invention.

Referring now to FIG. 3, an example of an elevator car 24 configured for use in an elevator system 20 resulting in reduced energy losses for a building is illustrated in more detail. The elevator car 24 described herein may be used in systems 20 that include a ventilation opening 50 as well as systems that do not include a ventilation opening 50. The elevator car 24 includes a wall structure 52 extending between a car roof 54 and a car floor 56. In one embodiment, the wall structure 52 includes a plurality of car panels 58 mounted to vertical supports 60 configured to provide the necessary stiffness to the car panels 58. In another embodiment, the plurality of car panels 58 themselves may form the wall structure 52 of the elevator car 24. In addition, a lining (not shown) may be attached to an interior surface of the car panels 58 to provide an aesthetically desirable appearance.

Figure 4:
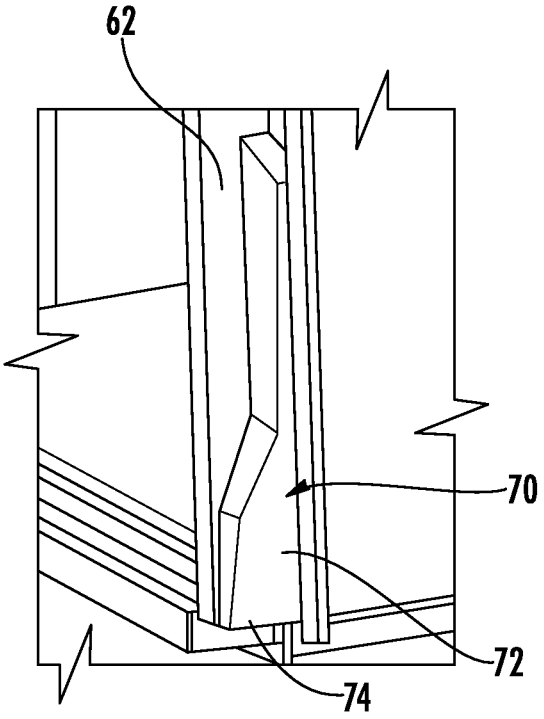
FIG. 4 is a perspective view of a portion of an elevator frame of the elevator car of FIG. 3 according to an embodiment of the invention.
Figure 5:
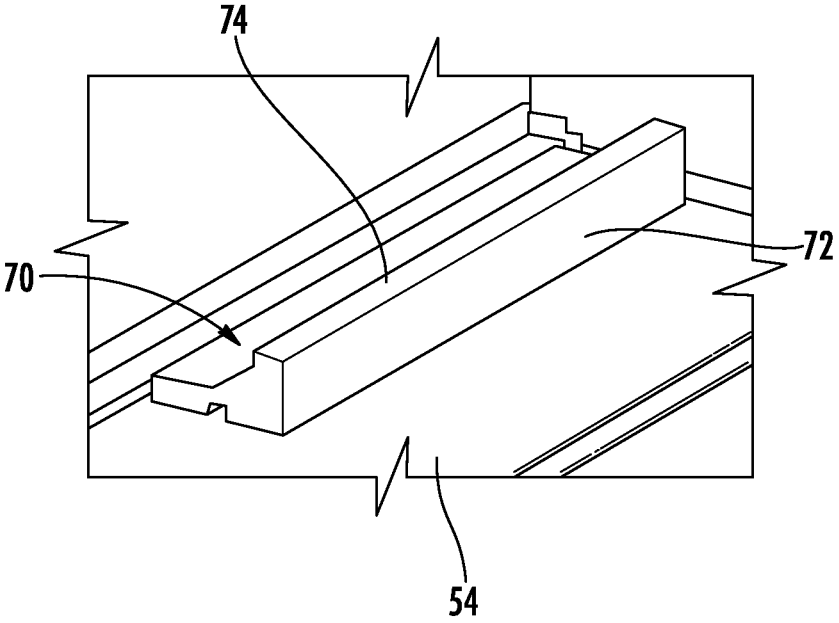
FIG. 5 is a perspective view of a portion of an elevator frame of the elevator car of FIG. 3 according to an embodiment of the invention.

Referring now to FIGS. 4 and 5, the ventilation system of the elevator system 20 may further include at least one air scoop 70 mounted to a portion of the elevator car 24. The one or more air scoops 70 may be attached to the wall structure 52 of the elevator car 24, for example near the bottom thereof as shown in FIG. 4. In one embodiment, the air scoop 70 is positioned within the portion of the wall structure 52 that forms a door column 62 configured to receive an elevator car door (not shown) when in the open position for example. Alternatively, or in addition, one or more air scoops 70 may be attached to an upper portion of the wall structure 52, such as near the car roof 54 for example. As shown in FIG. 5, an air scoop 70 may be mounted to a portion of the car roof 54 at any position, such as near a center of the roof 54 for example, as shown in FIG. 5. In embodiments including more than one air scoop, the air scoops may be substantially identical, or different.

The air scoops 70 are generally formed from a lightweight plastic, metal, composite or other suitable material having a fluid channel extending there through. The shape and size of the air scoop 70 is designed to optimize the amount of air flow between the hoistway 22 and the interior of the elevator car 24. In the illustrated, non-limiting embodiment, a first portion 72 of the air scoop 70 has an enlarged opening 74, configured as an air intake, to increase the amount of air drawn from the hoistway 22 into the scoop 70. Alternatively, the enlarged opening 74 may be configured as an air outtake to draw air or carbon dioxide from the elevator car 24 and into the hoistway 22.

The one or more air scoops 70 affixed to the elevator car 24 are intended to provide a controlled flow of air from the hoistway 22 into the interior of the elevator car 24. The controlled air flow of the provided by the one or more scoops 70, considered alone or in combination with the gaps or openings adjacent the car doors, satisfies the "effective area of ventilation apertures" situated within either an upper portion or a lower portion of the elevator car 24 as required by elevator code authorities or other regulations, such as the Lift Directive 95/16/CE under ESR 4.7 of Annex I for example.

The elevator system 20 described herein provides the benefit of improving the energy efficiency of a building by controlling not only the air flow into and out of the hoistway, but also the necessary air flow into and out of the elevator car, such as in the event that one or more passengers are trapped therein. In addition, the aesthetic appearance of the elevator car may be improved by reducing the number of holes formed therein for ventilation.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An elevator system, comprising a hoistway; and an elevator car movable within the hoistway between a plurality of landings, the elevator car including at least one air scoop fluidly coupling an interior of the elevator car to the hoistway, wherein a size and shape of the at least one air scoop is selected to control a fluid flow between the hoistway and the elevator car; and wherein the at least one air scoop is positioned within a portion of a wall structure that forms a door column configured to receive an elevator car door when in an open position.

2. The elevator system according to claim 1, wherein the hoistway does not include a ventilation opening configured to fluidly couple the hoistway to an air supply disposed outside the hoistway.

3. The elevator system according to claim 1, wherein the hoistway includes a ventilation opening configured to fluidly couple the hoistway to an air supply disposed outside the hoistway.

4. The elevator system according to claim 3, wherein the ventilation opening is selectively or continuously covered.

5. The elevator system according to claim 4, wherein a landing door is arranged at one or more of the plurality of landings, the landing door being optimized to allow a selected amount of fluid flow there through when in a closed position.

6. The elevator system according to claim 1, wherein the air scoop includes a first portion having an enlarged opening configured as an air intake or outtake.

7. The elevator system according to claim 1, wherein the at least one air scoop is mounted to a wall structure of the elevator car.

* * * * *